US006223495B1

(12) United States Patent
Shaw et al.

(10) Patent No.: US 6,223,495 B1
(45) Date of Patent: May 1, 2001

(54) VIBRATING SCREED WITH ROLLERS

(76) Inventors: Lee A. Shaw, 2672 Crestview Dr., Newport Beach, CA (US) 92660; Ronald D. Shaw, 1988 Pelican, Costa Mesa, CA (US) 92626

( * ) Notice: Subject to any disclaimer, the term of this patent is extended or adjusted under 35 U.S.C. 154(b) by 0 days.

(21) Appl. No.: 09/258,055

(22) Filed: Feb. 26, 1999

(51) Int. Cl.[7] ..... E04F 21/00

(52) U.S. Cl. ..... 52/749.1; 52/749.13; 52/741.4; 52/741.41; 52/742.1; 52/742.13; 52/DIG. 1; 404/118; 404/119; 404/114; 404/120; 264/333

(58) Field of Search ..... 52/749.1, 749.13, 52/741.4, 741.41, 742.1, 742.13, 364, DIG. 1; 404/114, 118, 119, 120; 264/333, 69, 70

(56) References Cited

U.S. PATENT DOCUMENTS

| | | | | |
|---|---|---|---|---|
| 1,513,592 | | 10/1924 | Johnson . | |
| 1,592,681 | | 7/1926 | Grothe . | |
| 1,838,635 | | 12/1931 | Pilj . | |
| 1,852,673 | | 4/1932 | Pilj . | |
| 1,891,764 | * | 12/1932 | Henderson | 264/70 |
| 1,939,007 | | 12/1933 | Heltzel . | |
| 2,095,060 | | 10/1937 | Geyer . | |
| 2,129,568 | | 9/1938 | De Biasi . | |
| 2,262,704 | | 11/1941 | Tompkins et al. . | |
| 2,296,453 | * | 9/1942 | Saffert | 264/333 |
| 2,319,526 | | 5/1943 | Wearn . | |
| 2,331,949 | | 10/1943 | Whiteman . | |
| 2,373,284 | | 4/1945 | Autrey . | |
| 2,375,276 | * | 5/1945 | Brown | 264/333 |
| 2,823,539 | | 2/1958 | Kersh et al. . | |
| 3,066,448 | | 12/1962 | Pinter . | |
| 3,284,973 | | 11/1966 | Ames et al. . | |
| 3,333,380 | | 8/1967 | Wolf . | |
| 3,451,179 | | 6/1969 | Kendzia . | |
| 3,920,221 | | 11/1975 | Berry et al. . | |
| 3,921,356 | | 11/1975 | Hughes . | |
| 4,158,937 | | 6/1979 | Henry . | |
| 4,379,683 | * | 4/1983 | Rodgers et al. | 425/62 |
| 4,437,828 | | 3/1984 | Egger . | |
| 4,581,863 | | 4/1986 | Thaler . | |
| 4,614,070 | | 9/1986 | Idland . | |
| 4,899,497 | | 2/1990 | Madl, Jr. . | |
| 4,913,582 | * | 4/1990 | Barrett | 404/119 |
| 4,995,760 | * | 2/1991 | Probst et al. | 404/119 |
| 5,133,915 | * | 7/1992 | Metten et al. | 264/333 |
| 5,281,050 | * | 1/1994 | Howard | 404/120 |
| 5,468,095 | * | 11/1995 | Dawson | 404/118 |
| 5,803,656 | * | 9/1998 | Turck | 404/103 |
| 5,857,803 | * | 1/1999 | Davis et al. | 404/102 |
| 5,971,656 | * | 10/1999 | Kitsmiller | 404/74 |
| 6,071,458 | * | 6/2000 | Mossi | 264/294 |
| 6,089,787 | * | 7/2000 | Allen et al. | 404/118 |

FOREIGN PATENT DOCUMENTS

| | | |
|---|---|---|
| 568457 | 10/1975 | (CH) . |
| 79813 | 8/1955 | (DK) . |

* cited by examiner

*Primary Examiner*—Beth A. Stephan
*Assistant Examiner*—Dennis L. Dorsey
(74) *Attorney, Agent, or Firm*—Stetina Brunda Garred & Brucker

(57) ABSTRACT

A vibrating screed with rollers for use in leveling a concrete pour. The screed comprises an elongate screed member defining opposed first and second ends and extensible between a pair of screed rails. A first and second roller are rotatably mounted to the screed member and protrude from respective ones of the first and second ends thereof. The rollers are rotatably movable along respective ones of the first and second screed rails. The screed additionally may comprise a motor to rotate the rollers and/or vibrate the screed member.

20 Claims, 4 Drawing Sheets

Fig. 1
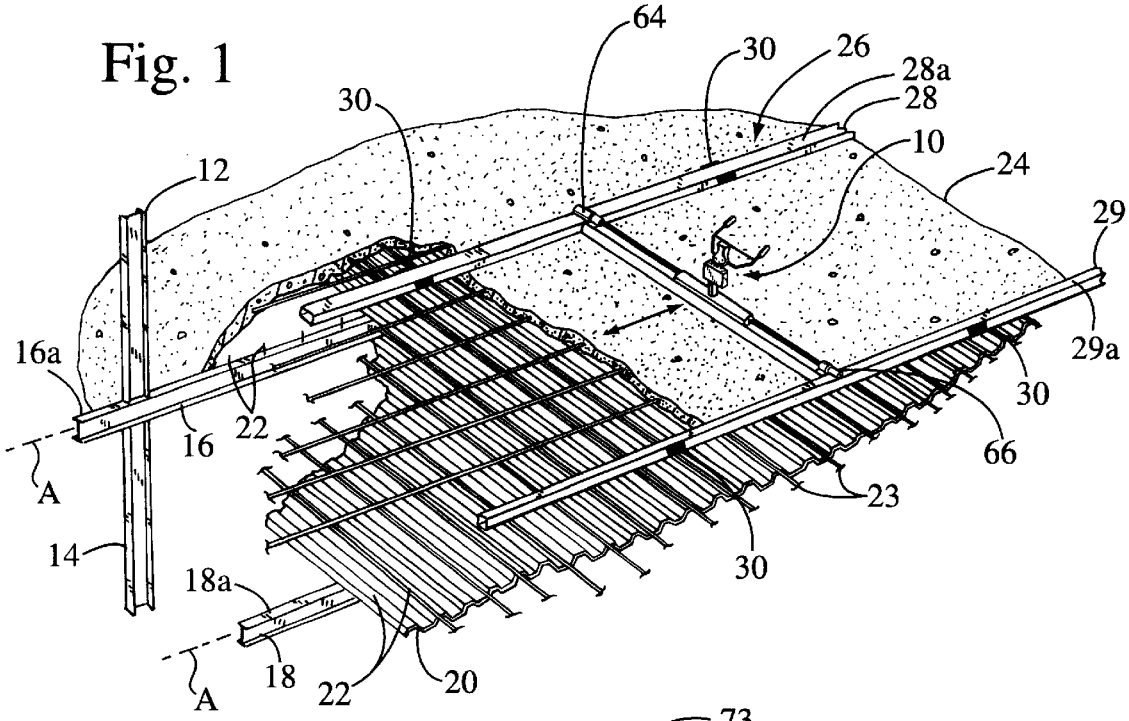
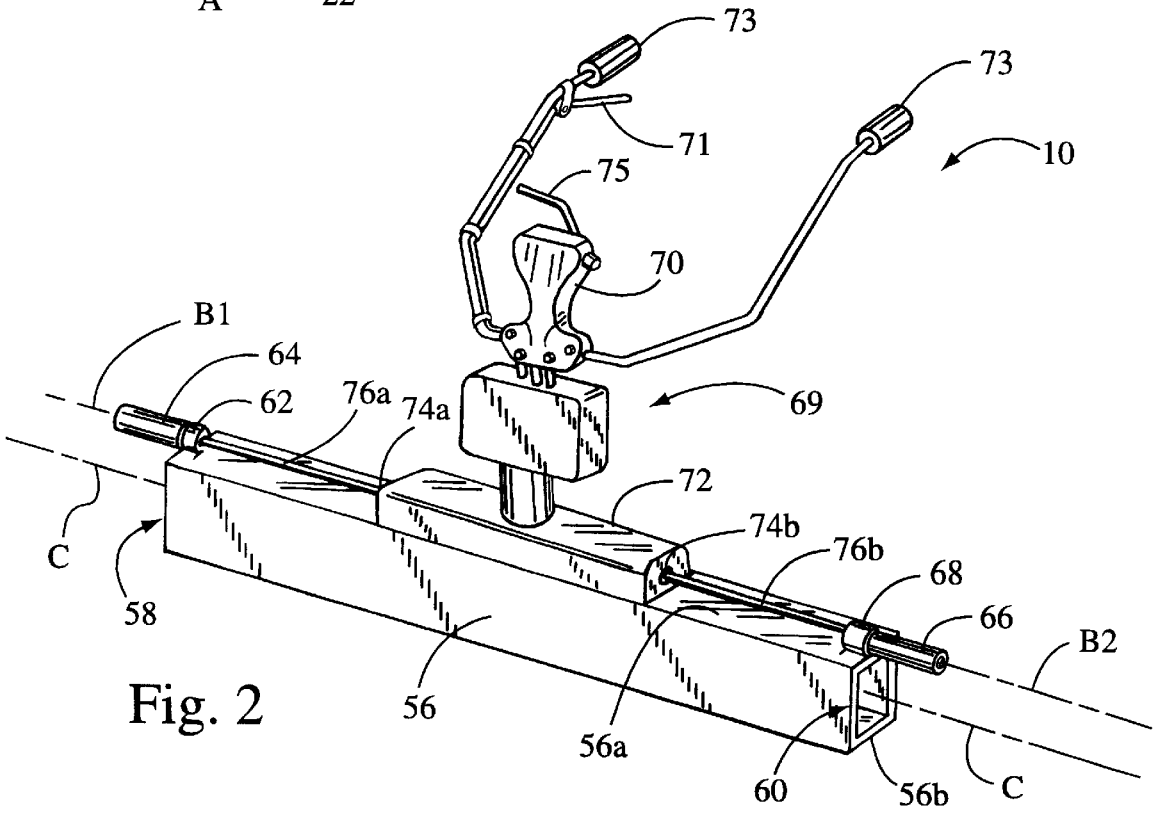
Fig. 2

Fig. 3
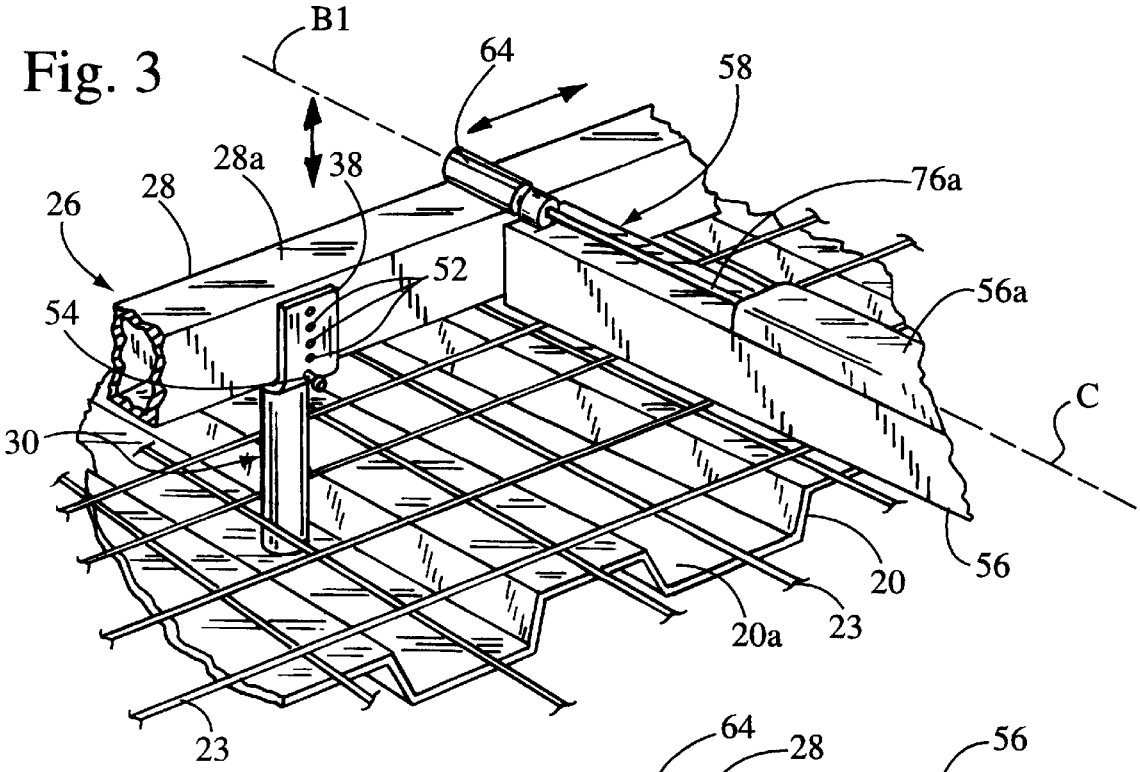
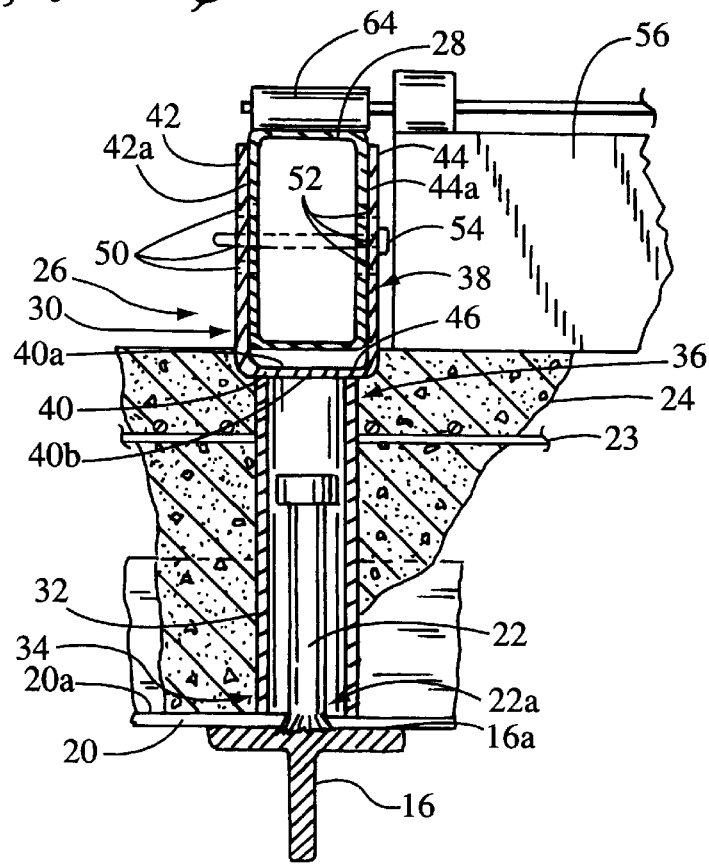
Fig. 4

Fig. 5
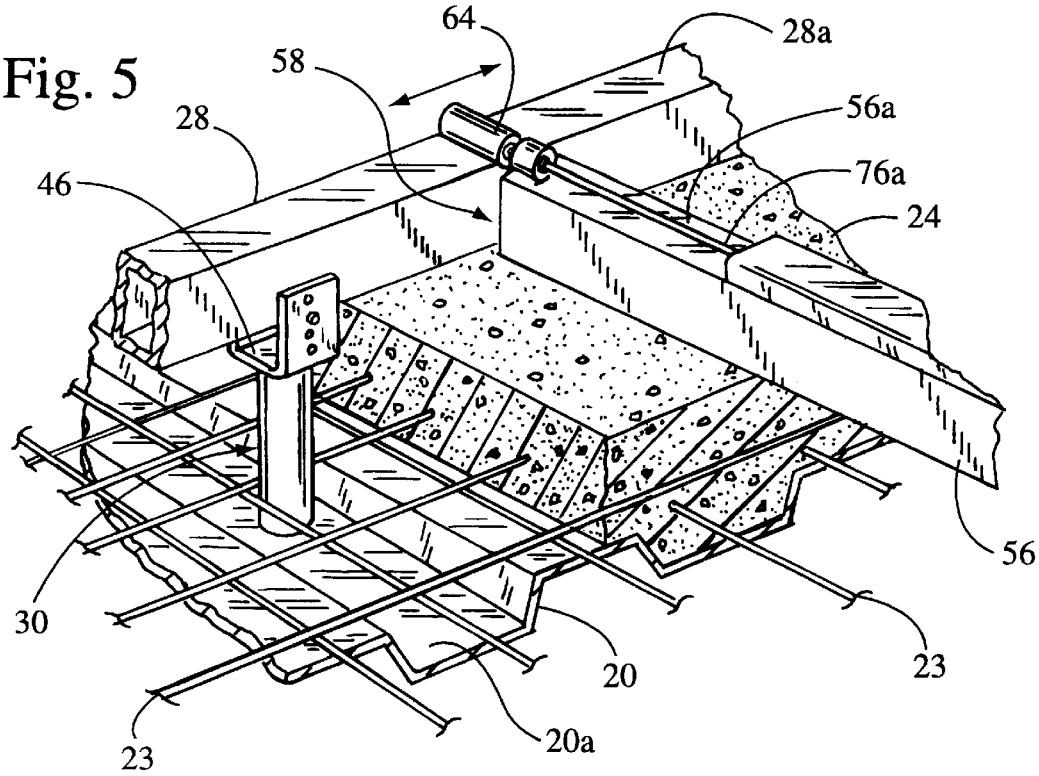
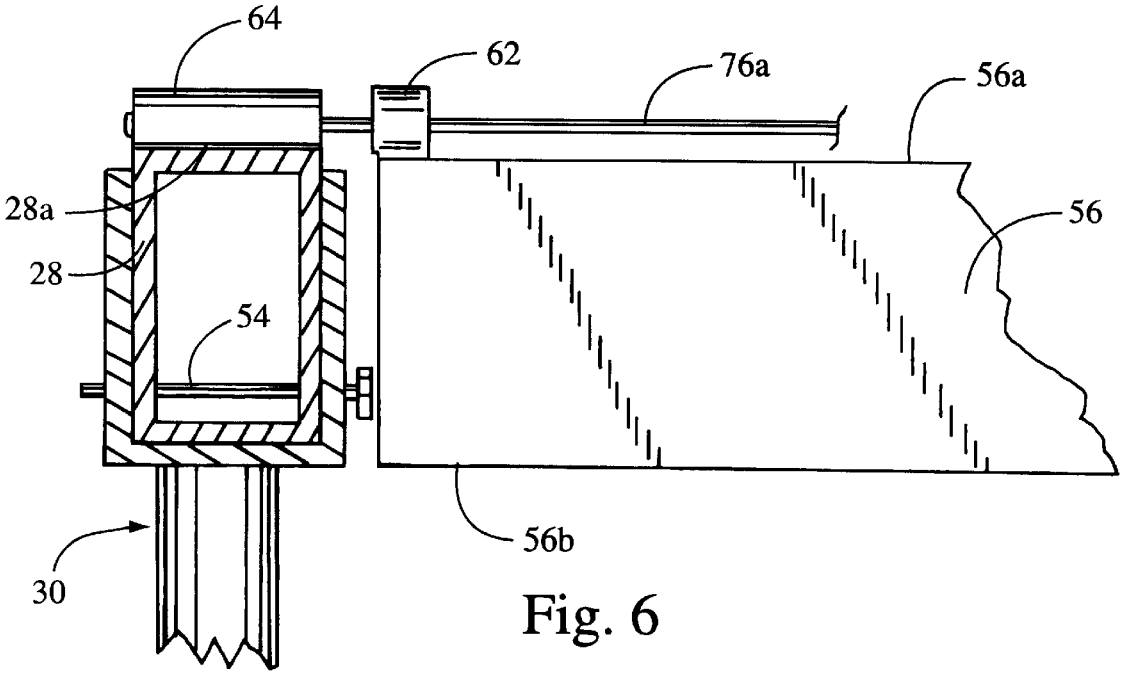
Fig. 6

VIBRATING SCREED WITH ROLLERS

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to screeds for leveling a concrete pour, and more particularly to a motorized, vibrating screed with rollers.

As is well known in the construction industry, many multi-story buildings are fabricated with composite decks. A composite deck is generally formed by the integrated combination of concrete and structural steel. Typically, multi-story buildings are formed with horizontal and vertical steel support beams and composite decks. The composite deck is formed by initially placing corrugated sheet metal decking across the top surfaces of the horizontal support beams wherein the deck is to be placed. Next generally elongate, vertical studs (Nelson studs) are welded to the corrugated sheet metal in linear alignment with the horizontal support beams such that the studs extend vertically upward from the top, horizontal surface of the structural beams to which they are attached. In this respect, the lower end of the Nelson stud is abutted against the upper surface of the metal decking in a position approximately above the longitudinal axis of the beam. Since the metal decking has a relatively thin cross-section, the welding procedure is operable to form an integral connection between the Nelson stud, metal decking and top surface of the beam. Concrete reinforcement material such as rebar or wire mesh is then placed over the top surface of the corrugated deck. Typically, the reinforcement material is supported by "chairs" to place the reinforcement material a prescribed distance above the deck's top surface. Concrete is then poured upon the upper surface of the corrugated sheet metal decking in a manner such that the concrete completely surrounds the exposed portions of each of the Nelson studs and the concrete reinforcement material. The interconnection of the structural steel beams, the corrugated sheet metal decking, the Nelson studs, the concrete reinforcement material and the concrete pour form the composite deck structure.

In composite deck construction, a certain concrete thickness is specified for the concrete poured upon the metal decking. The concrete thickness throughout the entire surface area of the composite deck must be uniform, thereby necessitating that the pour be leveled in a manner achieving such a uniform thickness. The leveling device used to level concrete pours is referred to as a screed. Typically, the screed is an elongate, section of material having a straight edge that is drawn over the concrete pour. In composite deck construction, the screed extends between and is supported by a pair of screed rails positioned at a prescribed height above the corrugated metal decking. The screed is supported by a pair of tabs that extend outwardly from the screed and rest upon a top surface of the screed rails. The screed rails support the screed at a prescribed uniform height above the metal decking such that the straight edge of the screed will level the concrete pour as the screed is being drawn along the length of the screed rails. Typically, the screed rails are placed upon adjacent, parallel support beams in a manner wherein each screed rail is generally parallel to the support beam to which it is attached.

The screed rails are attached to the support beams through the use of screed post assemblies. Typical screed post assemblies comprise a screed pad with a screed post extending upwardly therefrom. The screed pad must be anchored to the corrugated sheet metal decking by means of screws and/or adhesives. Once the screed pad is anchored to the metal decking, the screed post is threadably connected to the screed pad and the screed rail is pinch bolted to the screed post. The screed post height is then typically established by optical leveling procedures. The screed is then interfaced to the screed rail and subsequently drawn over the surface of the concrete pour.

In addition to the above-mentioned method, the screed rail may be secured through the use of a Nelson stud screed post assembly as described in Applicant's U.S. Pat. No. 5,212,919 of May 25, 1993. As such, the screed post assembly comprises a U-shaped bracket that is sized and configured to receive a screed rail. The bracket is attached to an elongate screed post that can interface with a Nelson stud. The screed post is configured to be coaxially alignable with the Nelson stud such that the post and bracket can be lowered upon the Nelson stud. The screed post and bracket are then supported by the Nelson stud at a location along the longitudinal axis of the support beam. The bracket attached to the screed post is configured to allow adjustment of the screed rail in a vertical direction in order to position the screed rail at the prescribed height above the metal decking.

As will be appreciated by those familiar with concrete construction techniques, drawing the screed over the poured concrete is very labor intensive. The concrete is poured onto the deck and the screed is manually drawn over the concrete by pulling the screed. The screed is difficult to pull due to the weight of the concrete that must be moved and the friction created between the tabs extending from the screed and the screed rails supporting such tabs. In forming thick decks, typically over 12 inches thick, there has been developed a vibrating screed in order to help move the vast quantities of concrete. The vibrating screed has a motor that vibrates the screed in order to help move and compact the concrete. However, the vibrating screed must still be manually pulled over the poured concrete. Drawing the screed over the concrete can lead to injuries to the concrete laborer due to the pulling he must perform to draw the screed over the un-level concrete pour.

The present invention addresses and overcomes the above-described deficiencies in prior art screeds by providing a screed that easily slides over the screed rails. In fact, the screed of the present invention is operable to vibrate and pull the screed over the concrete through the use of a motor. Therefore, the present invention provides a device that can easily move concrete without injury to the concrete laborer.

BRIEF SUMMARY OF THE INVENTION

In accordance with a preferred embodiment of the present invention, there is provided an apparatus for leveling a concrete pour that is useable in conjunction with a screed support system having a first and a second screed rails. The apparatus comprises an elongate screed member extensible between the first and the second screed rails and defining opposed first and second ends. Rotatably mounted to the screed member are first and second rollers that protrude from respective ones of the first and second ends thereof. Preferably, the first and second screed rails each define a respective top surface such that the first and second rollers are configured to be rotatably moveable upon respective ones of the top surfaces of the first and second screed rails.

The apparatus may further comprise a drive assembly for moving the screed member along the screed rails. The drive assembly includes a motor mechanically coupled to the first and second rollers and operative to produce a motor output which concurrently rotates the rollers. Furthermore, the drive assembly includes a transfer mechanism which is attached to the screed member and mechanically coupled to the motor and the first and second rollers. The transfer mechanism is operative to translate the motor output into the rotation of the first and second rollers. In order to transfer the motor rotation to the rollers, the drive assembly further includes a first and second elongate drive shaft for mechanically coupling the transfer mechanism to the first and second rollers. The rollers are attached to the screed member through the use of respective first and second brackets which rotatably support respective ones of the drive shafts. In order to facilitate movement of the screed member, there is additionally provided a handle attached to the screed member. Furthermore, the rollers may be fabricated from a rubber material to provide an adequate gripping surface along the screed rails.

Additionally, it is contemplated, that the top surfaces of the first and second screed rails are each formed to include a plurality of teeth. As such, both rails will define a pair of racks. Therefore, the first and second rollers will each be formed to include a plurality of splines so as to define a pair of gears. The gears will be engagable to and movable along respective ones of the racks in order to facilitate movement of the screed member over the poured concrete.

In accordance with the present invention, there is provided a method of leveling concrete poured over a surface. In the preferred method, a vibrating screed having a screed member that defines opposed first and second ends with first and second rollers rotatably mounted and protruding therefrom is used. The vibrating screed will additionally have a motor mechanically coupled to first and second rollers to facilitate rotation thereof. The method comprises the steps of securing a first screed rail above the surface and then securing a second screed rail above the surface in spaced relation to the first. Next, the concrete is poured over the surface between the first and second screed rails. Then, the first roller is placed upon the first screed rail and the second roller is placed upon the second screed rail. The first and second rollers are concurrently rotated by the motor such that the screed member is drawn over the concrete pour thereby leveling such pour. Additionally, the motor may vibrate the screed member in order to facilitate leveling of the concrete pour.

BRIEF DESCRIPTION OF THE DRAWINGS

These as well as other features of the present invention, will become more apparent upon reference to the drawings wherein:

FIG. 1 is a perspective view illustrating the manner in which the vibrating screed of the present invention is used in conjunction with a screed support system to conduct a leveling operation of a concrete pour during construction of a composite deck;

FIG. 2 is a front perspective view of the vibrating screed of the present invention;

FIG. 3 is a perspective view illustrating the manner in which a screed post assembly and screed rail of an exemplary screed support system are interfaced to the metal decking of the composite deck;

FIG. 4 is a cross-sectional view illustrating the manner in which the screed post assembly shown in FIG. 3 is interfaced to a Nelson stud of the composite deck;

FIG. 5 is a perspective view illustrating the manner in which a concrete pour is leveled through the use of the vibrating screed of the present invention;

FIG. 6 is a cross-sectional view illustrating the manner in which a roller of the vibrating screed of the present invention is operatively engaged to one of the screed rails of the screed support system;

DETAILED DESCRIPTION OF THE INVENTION

Figure 7:
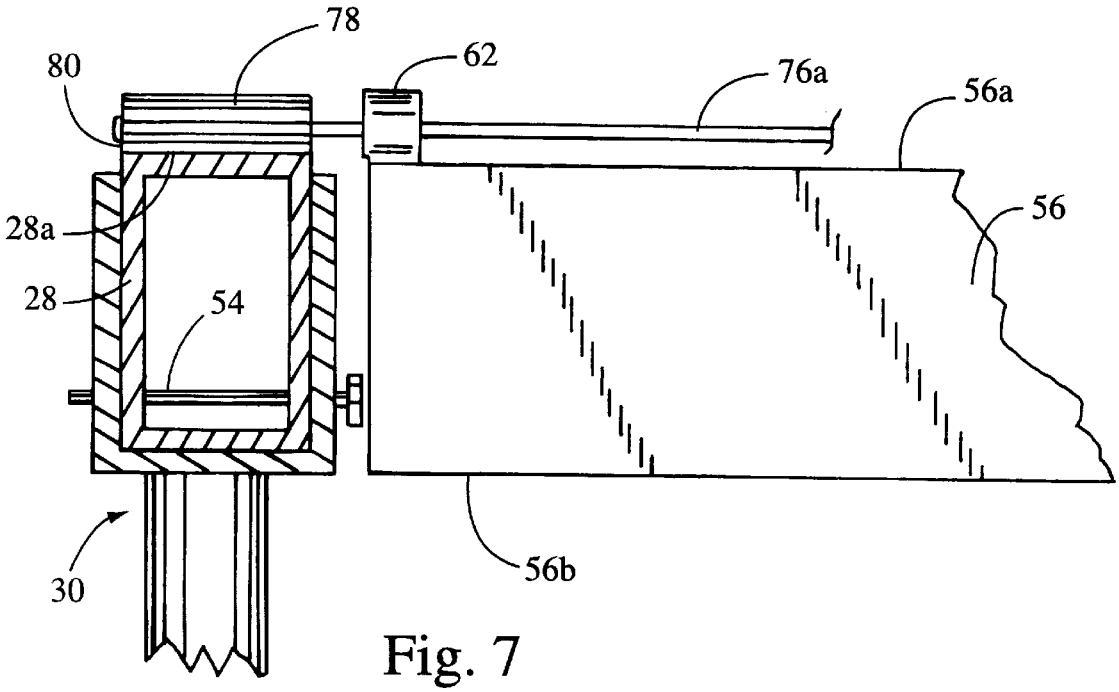
FIG. 7 is a cross-sectional view illustrating an alternate configuration of the roller and screed rail shown in FIG. 6.

Referring now to the drawings wherein the showings are for purposes of illustrating preferred embodiments of the present invention only, and not for purposes of limiting the same, FIG. 1 perspectively illustrates the manner in which a composite deck is fabricated using a vibrating screed 10 of the present invention.

Composite Deck Structure

As is well known in the building industry, composite decks are used in the construction of multilevel buildings that are constructed with a plurality of vertically disposed support columns 12, 14 interconnected to horizontally disposed support beams 16, 18 as seen in FIG. 1. Typically, vertical support columns 12, 14 and horizontal support beams 16, 18 comprise steel I-beams which are welded or riveted together. By interconnecting a plurality of vertical support columns 12, 14 with a plurality of horizontal support beams 16, 18, a load supporting framework is constructed. In order to form the composite deck, a layer of corrugated sheet metal decking 20 is placed upon the top surfaces 16*a*, 18*a* of respective horizontal support beams 16, 18. The decking 20 is placed upon adjacent, parallel support beams 16, 18 such that the decking 20 spans the open area defined between support beams 16, 18. Additionally, the decking 20 is spot welded to the horizontal support beams 16, 18 in order maintain the decking 20 in a proper position thereon.

Next, a plurality of elongate metal studs 22 known as Nelson studs are then welded to the upper surface 20*a* of deck 20. The Nelson studs 22 are positioned in general linear alignment with horizontal support beams 16, 18 and extend vertically upward from top surfaces 16*a*, 18*a*. In this regard, as seen in FIGS. 1 and 4, the lower end 22*a* of each Nelson stud 22 is abutted against the upper surface 20*a* of metal decking 20 in a position which is in generally vertical alignment with a longitudinal axis "A" extending through the center of each support beam 16, 18. Since the metal decking 20 has a relatively thin cross section (as seen in FIG. 4), the welding process is operative to integrally connect the metal decking 20 and Nelson stud 22 to the top surfaces 16*a*, 18*a* of support beams 16, 18 in the manner shown in FIG. 4. It will be recognized that each Nelson stud 22 used in constructing the metal framework is attached to a respective sheet of metal decking and a respective horizontal support beam. Additionally, a latticework of rebar 23 is supported above the metal decking 20. The rebar 23 is typically supported above the metal decking through the use of "chairs" (not shown) such that rebar 23 provides additional support to the composite deck as is currently known in the art. After attaching the Nelson studs 22 to the metal decking 20 and to a respective horizontal support beam 16, 18, then a layer of concrete 24 is poured upon the upper surface 20*a* of metal decking 20. The concrete 24 completely surrounds each Nelson stud 22 such that the horizontal support beam 16, 18, the metal decking 20, the Nelson stud 22, rebar 23 and the concrete 24 are integrally connected to form the composite deck structure.

Screed Support System

In order to properly level the concrete pour 24, the vibrating screed 10 is used with a screed support system 26 interfaced to the Nelson studs 22. The screed support system 26 comprises two identically configured screed rails 28, 29 and corresponding screed post assemblies 30 constructed in accordance with Applicant's U.S. Pat. No. 5,212,919 of May 25, 1993 and incorporated by reference herein. Specifically, as seen in FIG. 4, the screed post assembly 30 generally comprises an elongate screed post 32 having a first end 34 and a second end 36. The first end 34 is sized to extend over a Nelson stud 22 in a manner whereby screed post 32 extends vertically upwardly from upper surface 20*a* of metal decking 20. Therefore, the first end 34 of screed post 32 directly abuts the upper surface 20*a* of metal decking 20 when interfaced to a Nelson stud 22. Attached to the second end 36 of screed post 32 is a screed rail support channel 38. The support channel 38 comprises a middle portion 40 having an upper surface 40*a* and a lower surface 40*b*. In this respect, the second end 36 of screed post 32 is welded to the lower surface 40*b* of middle portion 40. Extending perpendicularly from upper surface 40*a* of middle portion 40 is a first flange portion 42 having a generally planar inner surface 42*a* and a second flange portion 44 with a generally planner second inner surface 44*a* that is substantially parallel to the first inner surface 42*a* of first flange portion 42. In this respect, upper surface 40*a* , first inner surface 42*a* and second inner surface 44*a* define a generally U-shaped recess 46.

The U-shaped recess 46 is sized and configured to slidably receive the conventional elongate screed rail 28 or 29, as best seen in FIGS. 3, 4 and 5. Reference will be made to screed rail 28, however, it will be recognized that screed rail 29 is identically configured. Screed rail 28 preferably has a generally rectangular cross-sectional configuration and defines a generally planar top surface 28*a*, while identically configured screed rail 29 defines a top surface 29*a*. It is contemplated that a rubber material may be affixed to the top surface 28*a*, 29*a* of respective rail 28, 29 in order to facilitate frictional engagement of the screed 10 as will be further explained below.

The support channel 38 of screed post assembly 30 includes a mechanism for rapidly adjusting the distance separating upper surface 40*a* of middle portion 40 from screed rail 28 when screed rail 28 is disposed within U-shaped recess 46. The adjustment mechanism comprises a first set of apertures 50 formed in the first flange portion 42 and a second set of apertures 52 formed in the second flange portion 44. As seen in FIG. 4, the first set 50 and the second set 52 of apertures are in generally, linear vertical alignment and symmetrically spaced such that each aperture comprising the first set 50 is coaxially aligned with a respective aperture comprising the second set 52. Therefore, a quick release pin 54 is slidably insertable between pairs of coaxially aligned apertures to support screed rail 28 when received into U-shaped recess 46. Pin 54 may be moved between horizontally aligned pairs of apertures to adjust the distance separating upper surface 40*a* of middle portion 40 from screed rail 28 as best seen in FIG. 4. Additionally, the screed rail 28 may have a set of parallel apertures formed within the sides of rail 28 for the receipt of pin 54. As such, screed rail 28 may be supported on top of pin 54 as seen in FIGS. 3 and 5, or rail 28 may be supported by pin 54 extending through the apertures formed within rail 28 as seen in FIG. 4.

Vibrating Screed with Rollers

The vibrating screed 10 is used in conjunction with the screed rail 28. Referring to FIG. 2, the vibrating screed 10 comprises a generally elongate screed member 56 having a top surface 56*a*, a bottom surface 56*b*, a first end 58 and a second end 60. The screed member 56 has a generally rectangular cross-section such that bottom surface 56*b* can be used to screed or level the concrete pour 24 as will be further explained below. As will be recognized to those of ordinary skill in the art, the screed member 56 may have alternate cross-sectional configurations such as being L-shaped or triangularly shaped. Rotatably mounted to the first end 58 via a first bracket 62 is a first roller 64. The first roller 64 has a central axis "B1" about which the roller 64 is rotatable as seen in FIG. 2. The first roller 64 is attached to the first end 58 of screed member 56 such that axis "B1" is generally parallel to a central longitudinal axis "C" of the screed member 56. The first roller 64 is supported by first bracket 62 such that at least a portion of the first roller 64 extends outwardly from the first end 58. A second roller 66 is similarly attached to the second end 60 of screed member 56. Therefore, as seen in FIG. 2, the second roller 66 is attached to the second end 58 of screed member 56 through the use of second bracket 68 such that a portion of the second roller 66 extends outwardly from the second end 60. Additionally, the second roller 66 is rotatable about a central axis "B2" that is substantially parallel to the longitudinal axis "C" of screed member 56 and coaxially aligned with the first axis "B1".

Figure 8:
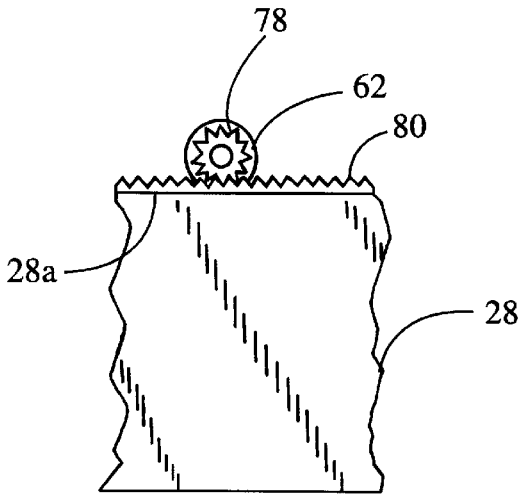
FIG. 8 is a partial side-elevational view of the roller and screed rail shown in FIG. 7.

Both the first roller 64 and the second roller 66 have a generally circular cross-sectional configuration such that both the first or second rollers 64, 66 are rotatable along an upper surface 28*a* of screed rail 28 (or upper surface 29*a* of screed rail 29). As seen in FIGS. 6 and 7, the rollers 64 and 66 are positioned above the lower surface 56*b* of screed member 56 in order for proper screed operation. The outer surface of the rollers 64, 66 may be formed of a rubber material to facilitate frictional retention upon screed rail 28. In a second embodiment of the present invention, the rollers 64, 66 may comprise splines 78 that are engagable to teeth 80 formed on the upper surface 28*a* of screed rail 28 as seen in FIGS. 7 and 8. As will be recognized, screed rail 29 may additionally be furnished with teeth 80 on upper surface 29*a*. The splines 78 are sized and configured to be receivable into the corresponding teeth 80 in order to facilitate rotation and movement of the rollers 64, 66 along the length of screed rails 28, 29. Therefore the pair of screed rails 28, 29 with teeth 80 formed thereon define a pair of racks. The rollers 64,66 formed with splines 78 define a pair of gears that are engagable to and movable along respective ones of the racks.

The vibrating screed 10 further comprises a drive assembly 69 for moving the screed member 56 along the screed rails 28, 29. The drive assembly 69 includes a rotating gas motor 70 coupled to the screed member 56. The motor 70 vibrates the screed member 56 typically through the use of an off-center cam in order to facilitate drawing the screed 10 and compacting the concrete pour 24. In the vibrating screed 10 of the present invention, the drive assembly 69 further includes a transfer mechanism 72 (i.e., transmission) coupled to motor 70. The transfer mechanism 72 has a first output 74*a* and a second output 74*b* in order to transfer the rotational motion of motor 70. Therefore, the transfer mechanism 72 comprises a set of internal gears operative to equally distribute the rotational motion produced by motor 70 to a first drive shaft 76*a* coupled to the first output 74*a* and to a second drive shaft 76*b* coupled to second output 74*b*. The rotating motor 70 can provide torque equally to both driveshafts 76*a*, 76*b*. As seen in FIG. 2, first drive shaft 76*a* is coupled to first roller 64 and second drive shaft 76*b* is coupled to second roller 68. The driveshafts 76*a*, 76*b* are operative to rotate respective rollers 64, 66 while transfer mechanism 72 is operative to synchronize the rotation of the rollers 64, 66 such that each rotate at the same rate and in the same direction. Additionally the motor 70 is provided with a throttle control 71 to control the speed of rotation of the rollers 64, 66.

In order to draw the screed 10 over the concrete 24, there is provided a set of handles 73 attached to screed member 56 and operative to control and position the screed 10. As will be recognized by those of ordinary skill in the art, the transfer mechanism 72 may also be provided with a gear selector 75 to reverse the rotation of rollers 64, 66 and to provide a neutral position such that the motor 70 does not engage the driveshafts 76*a* and 76*b* and only vibrates the screed member 56. Therefore, the rollers 64, 66 may be freely rotatable about a respective axis "B1" or "B2" such that the screed 10 can be drawn over concrete 24 without the aid of motor 70 rotating rollers 64,66.

Preferred Mode of Operation

Now having described the screed support system 26 and the vibrating screed with rollers 10, the manner of how to fabricate a composite deck structure with the screed support system 26 and the vibrating screed with rollers 10 will be explained. Once the metal decking 20 and Nelson studs 22 have been affixed to horizontal support beams 16, 18, the layer of rebar 23 is placed above the metal decking 20. Next, at least four identically configured screed post assemblies 30 are placed upon respective Nelson studs 22. Specifically, as seen in FIG. 1, a first pair of screed post assemblies 30 are attached to a pair of Nelson studs extending upward from support beam 16, while a second pair of screed post assemblies 30 are attached to a pair of Nelson studs extending upward from support beam 18. Next screed rail 28 is attached to and extended between the first pair of screed post assemblies 30 on support beam 16, and the second screed rail 29 (configured identically to screed rail 28) is attached to and extended between the second pair of screed post assemblies 30 on support beam 18. As will be recognized, due to the support beams 16, 18 being disposed in generally parallel relationship to each other, the screed rails 28 and 29 will be disposed in a similar relationship.

The height of the concrete pour may be prescribed by adjusting the height of the screed rails 28, 29. Specifically, a respective quick release pin 54 may be positioned such that screed rails 28, 29 are a desired height above the metal decking 20. Further, a suitable drainage for the pour can be provided by adjusting relative heights between screed post assemblies 30. With the desired height determined, concrete 24 is then poured upon the decking 20 in the area between the screed rails 28 and 29.

The vibrating screed with rollers 10 is then positioned between screed rails 28 and 29 such that screed member 56 is positioned generally perpendicularly and horizontally between screed rails 28 and 29. The screed member 56 is supported at the desired height above metal decking 20 by first roller 64 which rotates along the top surface 28*a* of screed rail 28 and second roller 66 which rotates along the top surface 29*a* of second screed rail 29. Therefore, the length of screed member 56 is such that rollers 64, 66 extending therefrom are placeable upon a respective top surface 28*a*, 29*a* of screed rail 28 or 29.

Since the first and second rollers 64, 66 can be freely rotatable, the screed member 56 is easily pulled with the pair of handles 73 over concrete pour 24 as seen in FIG. 1. The rotation of the rollers 64, 66 along the top surfaces 28*a*, 29*a* of respective screed rails 28, 29 allows the screed 10 to be drawn over the concrete pour 24 with less effort than required to pull a conventional screed. The rollers 64, 66 (when freely rotatable) reduce the friction between the screed rails 28, 29 and the screed member 56 supported thereon. As will be recognized to those of ordinary skill in the art, the screed member 56 may be vibrated by motor 70 in order to compact and help move the concrete pour 24 as screed 10 is being drawn thereover.

Alternatively, as previously described, the rollers 64, 66 may be rotated by motor 70. Each roller 64, 66 will pull the screed 10 over the concrete pour as it is being rotated by motor 70. Since each roller 64, 66 is fabricated from rubber, each roller 64, 66 will frictionally engage the top surface 28*a*, 29*a* of a respective screed rail 28, 29. Therefore, each roller 64, 66 pulls screed member 56 in order to level concrete pour 24. The screed member 56 may additionally vibrate by motor 70 such that the concrete pour 24 is moved and compacted more easily by screed member 56. The speed of the rollers 64, 66 may adjusted via throttle control 71 to draw the screed 10 over the concrete pour at a rate which facilitates compaction and leveling thereof. Additionally, the direction of rotation of rollers 64, 66 may be changed when needed by gear selector 75.

The engagement between rollers 64, 66 and a respective screed rail 28, 29 may be further enhanced by each roller 64, 66 comprising splines 78 as previously described. The splines 78 are engagable to the teeth 80 in screed rails 28, 29. As seen in FIGS. 7 and 8, the splines 78 of rollers 64, 66 mesh with respective teeth 80 to draw the screed member 56 along each rail 28, 29 as the rollers 64, 66 rotate.

After the concrete pour has been leveled and compacted to the determined height by screed member 56, the screed 10 is removed from the screed rails 28 and 29. Next, the screed rails 28, 29 are removed from respective screed post assemblies 30. The screed post assemblies 30 are then removed from a respective Nelson stud 22 and the opening remaining within the concrete pour 24 from such removal is then filled with a suitable material. Therefore, the screed post assemblies 30 and screed rails 28, 29 can be reusable for another section of the pour.

Additional modifications and improvements of the present invention may also be apparent to those of ordinary skill in the art such as varying the configuration of the rollers 64, 66 or using separate motors for vibrating the screed and powering the rollers. Thus, the particular combination of parts described and illustrated herein is intended to represent only certain embodiments of the present invention, and is not intended to serve as limitations of alternative devices within the spirit and scope of the invention.

What is claimed is:

1. An apparatus for leveling a concrete pour useable in conjunction with a screed support system having first and second spaced screed rails each defining a respective top surface, the apparatus comprising:

an elongate screed member extensible between the screed rails and below the screed rail top surfaces; and first and second rollers protruding laterally outwardly beyond opposing ends of said screed member, the rollers being rotatably movable along the screed rail top surfaces.

2. The apparatus of claim 1 further comprising a motor mechanically coupled to the screed member and operative to vibrate the screed member.

3. The apparatus of claim 2 wherein the motor is mechanically coupled to the first and second rollers and operative to concurrently rotate the first and second rollers.

4. The apparatus of claim 3 wherein the first and second rollers are each fabricated from a rubber material.

5. The apparatus of claim 1 further comprising a drive assembly for moving the screed member along the screed rails, the drive assembly including a motor mechanically coupled to the first and second rollers and operative to produce a motor output which concurrently rotates the first and the second rollers.

6. The apparatus of claim 5 wherein the drive assembly further includes a transfer mechanism which is attached to the screed member and mechanically coupled to the motor and the first and second rollers, the transfer mechanism being operative to translate the motor output into the rotation of the first and the second rollers.

7. The apparatus of claim 6 wherein the drive assembly further includes first and second elongate drive shafts for mechanically coupling the transfer mechanism to respective ones of the first and second rollers.

8. The apparatus of claim 7 wherein the drive assembly further includes first and second rollers attached to the screed member adjacent respective ones of the opposed ends thereof for rotatably supporting respective ones of the first and second drive shafts.

9. The apparatus of claim 1 further comprising at least one handle attached to the screed member to facilitate movement thereof along the first and second screed rails.

10. The apparatus of claim 1 wherein:

the top surfaces of the first and second screed rails are each formed to include a plurality of teeth so as to define a pair of racks; and the first and second rollers are each formed to include a plurality of splines so as to define a pair of gears which are engagable to and movable along respective ones of the racks.

11. A method of leveling concrete poured over a surface through the use of a vibrating screed having a screed member defining opposed first and second ends, first and second rollers rotatably mounted to the screed member and protruding from respective ones of the first and second ends, and a motor operative to rotate the first and second rollers, the method comprising the steps of:

a) securing a first screed rail above the surface;

b) securing a second screed rail above the surface in spaced relation to the first screed rail;

c) pouring concrete over the surface;

d) placing the first roller upon the first screed rail and the second roller upon the second screed rail; and e) concurrently rotating the first and second rollers with the motor to thereby draw the screed member over the concrete pour.

12. The method of claim 11 wherein step (e) further comprises vibrating the screed member with the motor.

13. An apparatus for leveling a concrete pour useable in conjunction with a screed support system having a first and a second spaced screed rails, the apparatus comprising:

an elongate screed member extensible between the first and the second screed rails and defining opposed first and second ends and respective top surfaces;

first and second rollers configured to be rotatably moveable along said respective top surfaces and rotatably mounted to the screed member and protruding from respective ones of the first and second ends thereof; and a motor mechanically coupled to the screed member for vibrating the screed member and mechanically coupled to the first and second rollers for concurrently rotating said rollers.

14. The apparatus of claim 13 wherein the first and second rollers are each fabricated from a rubber material.

15. The apparatus of claim 13 further comprising a drive assembly for moving the screed member along the screed rails, the drive assembly including a motor mechanically coupled to the first and second rollers and operative to produce a motor output which concurrently rotates the first and the second rollers.

16. The apparatus of claim 15 wherein the drive assembly further includes a transfer mechanism which is attached to the screed member and mechanically coupled to the motor and the first and second rollers, the transfer mechanism being operative to translate the motor output into the rotation of the first and the second rollers.

17. The apparatus of claim 16 wherein the drive assembly further includes first and second elongate drive shafts for mechanically coupling the transfer mechanism to respective ones of the first and second rollers.

18. The apparatus of claim 17 wherein the drive assembly further includes first and second rollers attached to the screed member adjacent respective ones of the opposed ends thereof for rotatably supporting respective ones of the first and second drive shafts.

19. The apparatus of claim 13 further comprising at least one handle attached to the screed member to facilitate movement thereof along the first and second screed rails.

20. The apparatus of claim 13 wherein:

the top surfaces of the first and second screed rails are each formed to include a plurality of teeth so as to define a pair of racks; and the first and second rollers are each formed to include a plurality of splines so as to define a pair of gears which are engageable to and movable along respective ones of the racks.

* * * * *